US006115846A

United States Patent [19]

Truesdale

[11] Patent Number: 6,115,846

[45] Date of Patent: Sep. 12, 2000

[54] HEADGEAR COMBINED WITH A FAN, ELECTRONIC COMMUNICATION DEVICE AND BINOCULARS

[76] Inventor: Max T Truesdale, 2021 Picadilly Dr., Cayce, S.C. 29033-1429

[21] Appl. No.: 09/201,494

[22] Filed: Nov. 30, 1998

[51] Int. Cl.[7] ..... A42B 3/28

[52] U.S. Cl. ..... 2/209.13; 2/7; 2/171.3; 2/906

[58] Field of Search ..... 2/7, 171.3, 209.13, 2/906, 422, DIG. 1

[56] References Cited

U.S. PATENT DOCUMENTS

| | | | |
|---|---|---|---|
| 2,649,019 | 8/1953 | Hartline et al. . | |
| 3,430,261 | 3/1969 | Benner . | |
| 4,744,106 | 5/1988 | Wang | 2/171.3 |
| 4,802,243 | 2/1989 | Griffiths . | |
| 4,839,926 | 6/1989 | Choi . | |
| 4,856,089 | 8/1989 | Horton . | |
| 5,046,192 | 9/1991 | Ryder . | |
| 5,181,139 | 1/1993 | Benitez . | |
| 5,282,086 | 1/1994 | Goldstein . | |
| 5,410,746 | 4/1995 | Gelber . | |
| 5,465,421 | 11/1995 | McCormick et al. . | |
| 5,526,178 | 6/1996 | Goldstein et al. . | |
| 5,634,201 | 5/1997 | Mooring . | |

*Primary Examiner*—Diana Oleksa
*Attorney, Agent, or Firm*—Michael A Mann; Michael E Wever; Nexsen Pruet Jacobs & Pollard LLP

[57] ABSTRACT

Headgear combined with binoculars, a headset, and a fan. The binoculars are mounted on the brim of the headgear using a hinge so the they can be placed above the brim while not in use. The headset contains earphones preferably for each ear. The earphones are independently rotatable so that they may be placed out of the way while not in use and may be adjusted both horizontally and vertically. On top of the crown of the headgear a fan is mounted to blow on the user to keep him cool.

20 Claims, 4 Drawing Sheets

HEADGEAR COMBINED WITH A FAN, ELECTRONIC COMMUNICATION DEVICE AND BINOCULARS

BACKGROUND OF THE INVENTION

1. Field of the Invention

The present invention relates to headgear combined with a fan, electronic communications device and binoculars. In particular, the present invention relates to a helmet that contains binoculars, a headset and a fan for use in sporting events.

2. Discussion of Background

Sports fans enjoy supporting their team by wearing apparel, such as shirts, coat, and hats, with the team logo, mascot, or name. When the team plays at home, a fan can be recognized simply by his outfit. At the game, many fans carry a radio, binoculars, and other devices that enhance viewing the game. While the game is being played some fans have one hand carrying the radio with the other hand holding the binoculars. Unfortunately, holding such devices during the game interrupts the ability to clap and becomes very tiresome. Moreover, most fans are unable to hold a radio and binoculars to watch the game and eat at the same time.

There have been several attempts in combining a radio with headwear. However, such attempts are inadequate by not providing a means of enhancing the viewing of a sporting event, by including binoculars. Consequently, there is need for a hands-free device that allows a fan to simultaneously hear the broadcast of the game and have an enhanced view of the field.

SUMMARY OF THE INVENTION

According to its major aspects and broadly stated, the present invention is headgear combined with binoculars, a headset, and a fan. The binoculars are mounted on the brim of the headgear using a hinge so that they can be placed above the brim while not in use. The headset contains earphones preferably for each ear. The earphones are independently rotatable so that they may be placed out of the way while not in use and may be adjusted both horizontally and vertically. On top of the crown of the headgear a fan is mounted to blow on the user to keep him cool.

The combination of binoculars, headset, and fan with headgear is a major feature of the present invention. This combination allows an user to enjoy enhanced perception of the game while keeping cool. Moreover, the invention allows the user to enjoy increased perception of the game while not having to carrying any items to the game.

An important advantage of the present invention is the ability of the user to use the device in a hands-free manner. This advantage not only reduces the fatigue brought about from having to hold many devices the entire game and allows the user to have his hands free to eat or clap.

Another important advantage of the present invention is that the user does not have to carry several devices to a game. This advantage not only reduces the amount of items needs to be taken to a game, but also reduces the amount of devices that are accidentally left at the game.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
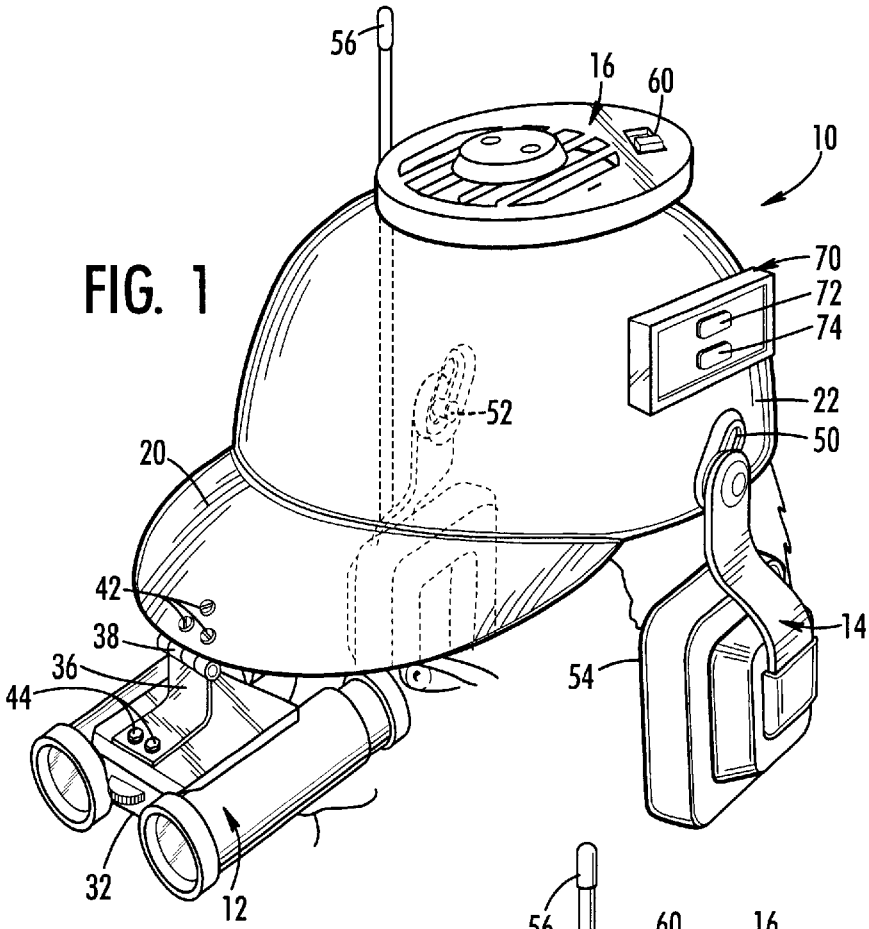
FIG. 1 is a perspective view of the headgear being worn by a person, according to a preferred embodiment of the present invention.

Referring now to the figures, the present invention is headgear in combination with binoculars, an electronic communications device and a fan. Headgear according to the present invention is referred to generally in the figures using reference number 10. Headgear 10 contains binoculars 12, a headset 14 and a fan 16. Headgear 10 may be a cap, hat, helmet, or any other piece that fits on a person's head and contains a brim 20. Headgear 10 is preferably made of hard plastic, but may be made of fabric, leather, or any other material of sufficient rigidity to support binoculars 12 on brim 20.

Figure 2:
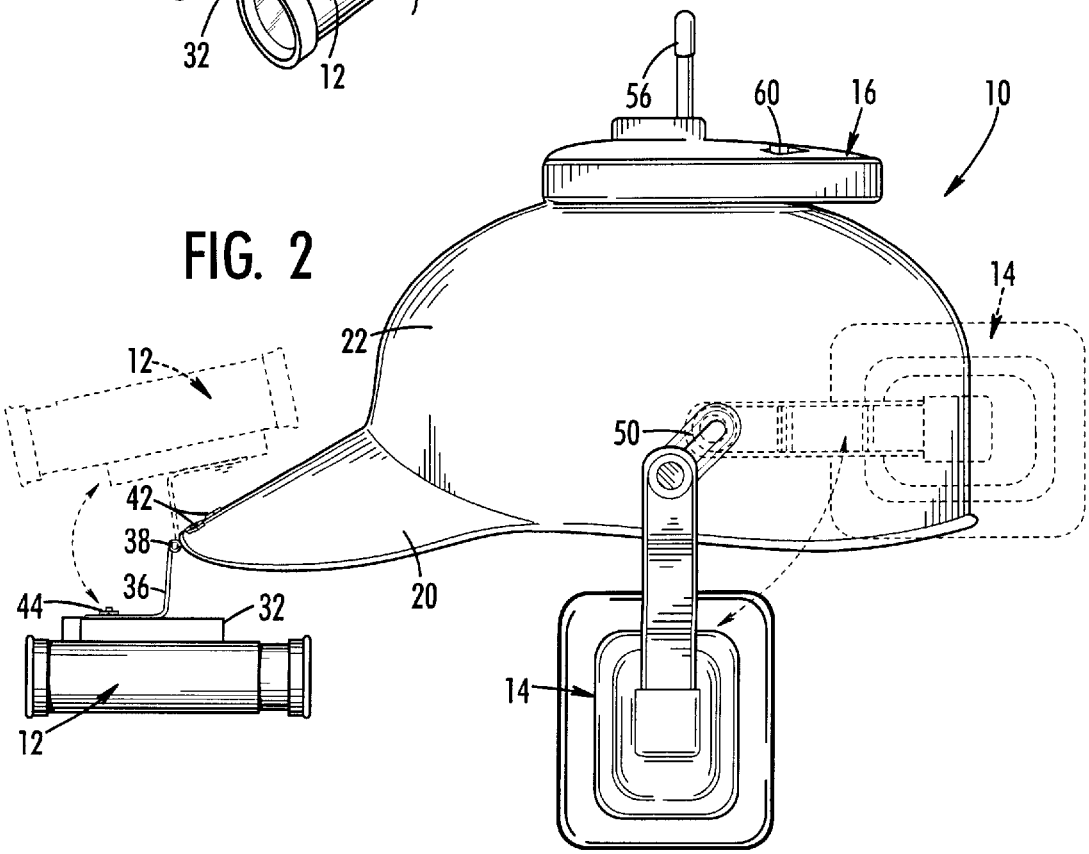
FIG. 2 is a left side view of the headgear, according to a preferred embodiment of the present invention.
Figure 3:
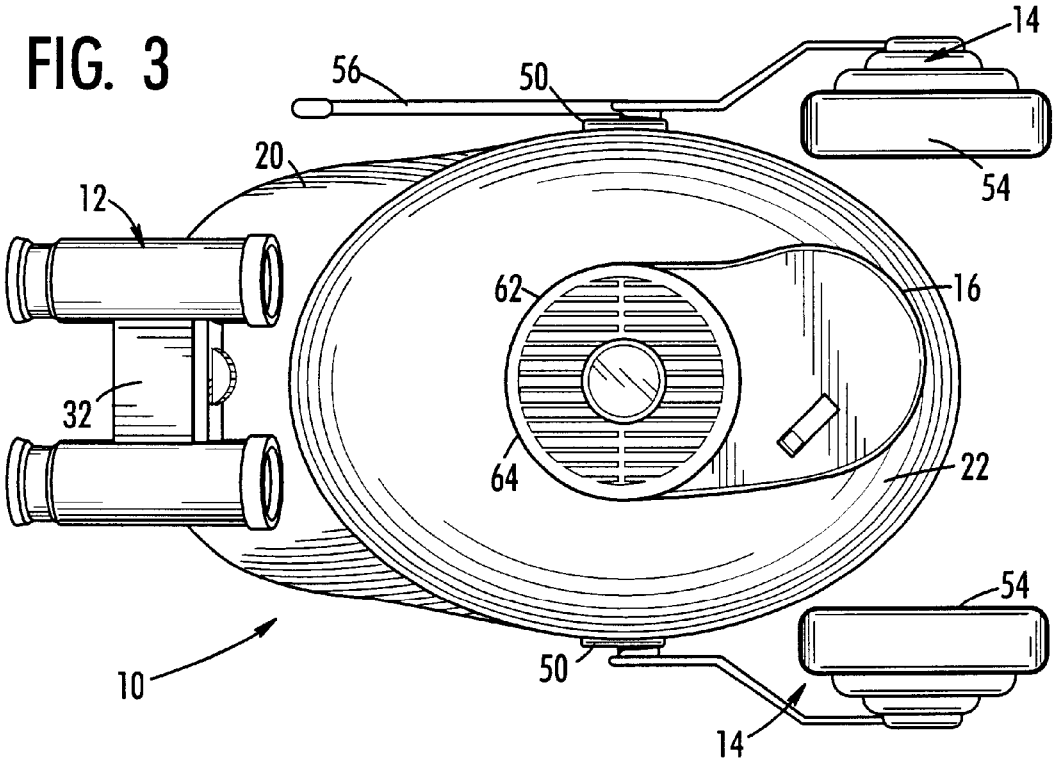
FIG. 3 is a top view of the headgear, according to a preferred embodiment of the present invention.
Figure 4:
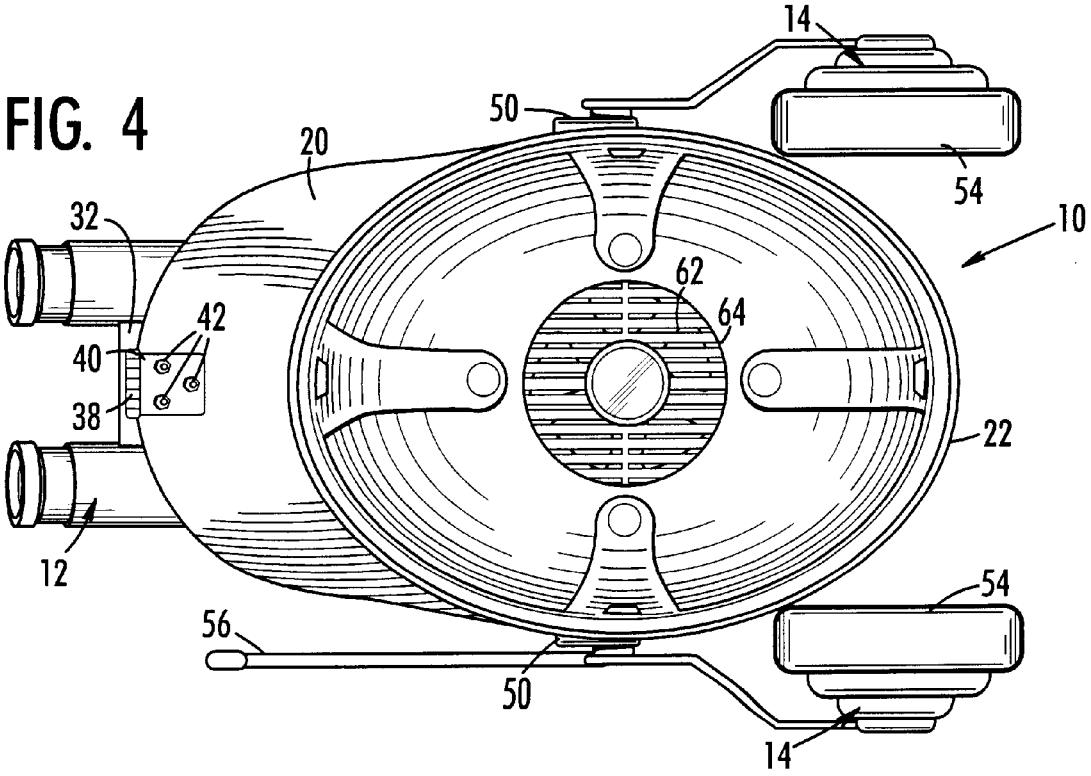
FIG. 4 is a bottom view of the headgear, according to a preferred embodiment of the present invention.
Figure 5:
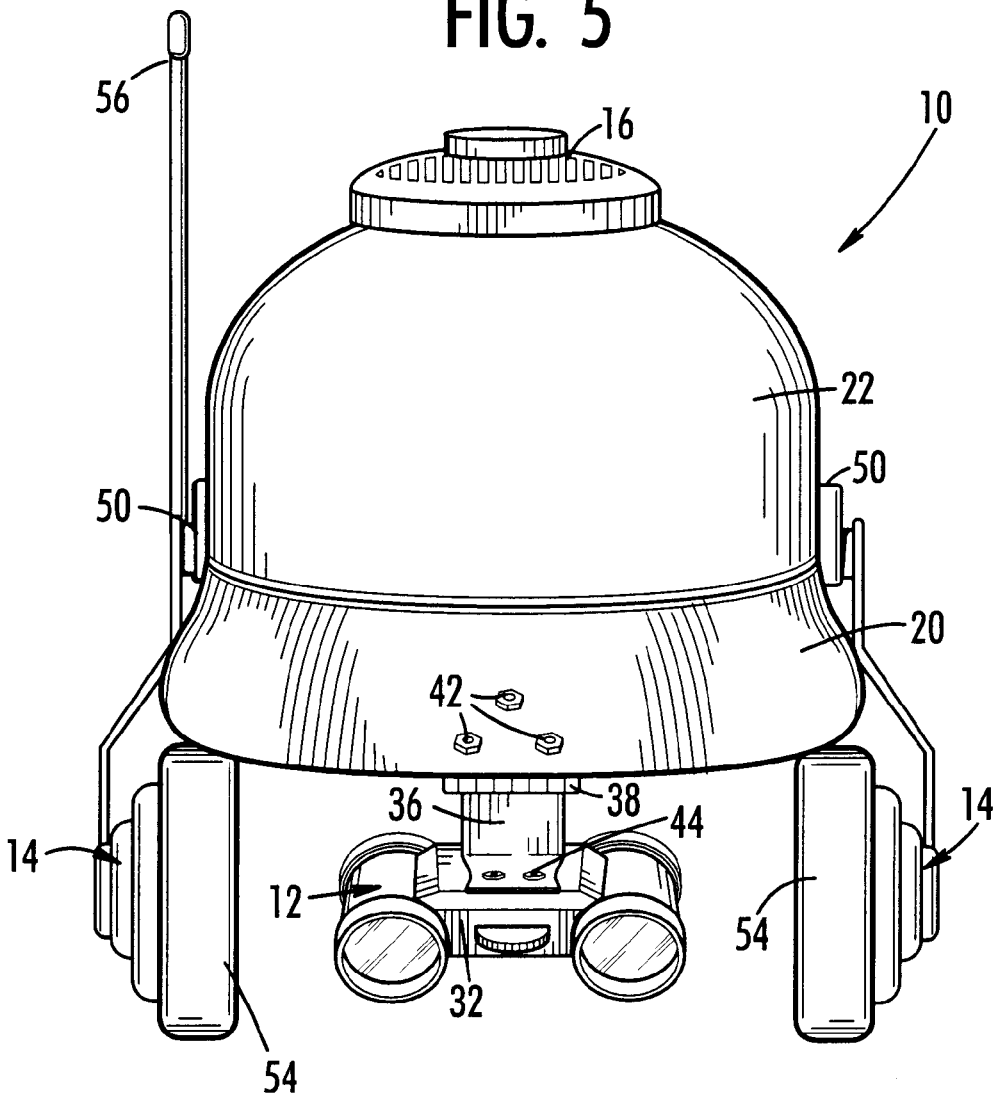
FIG. 5 is a perspective view the headgear, according to a preferred embodiment of the present invention.
Figure 6A:
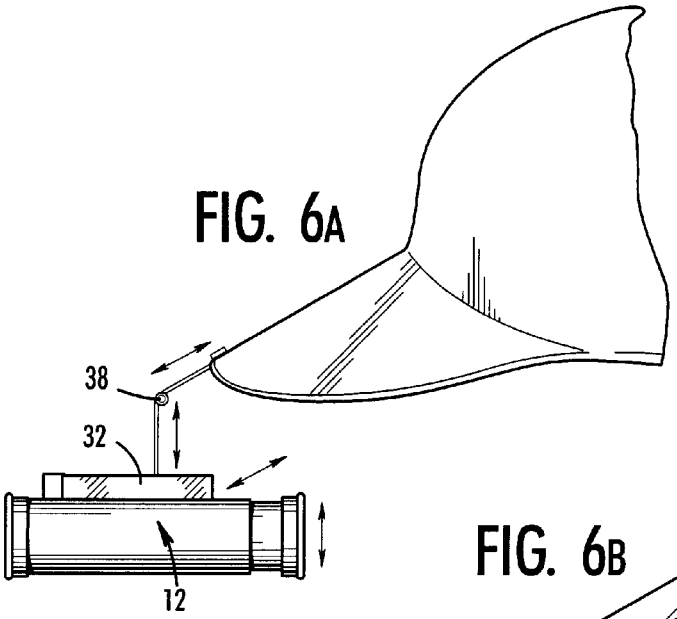
FIG. 6A is a side view the headgear with vertical and horizontal adjustments for the binoculars, according to a preferred embodiment of the present invention.
Figure 6B:
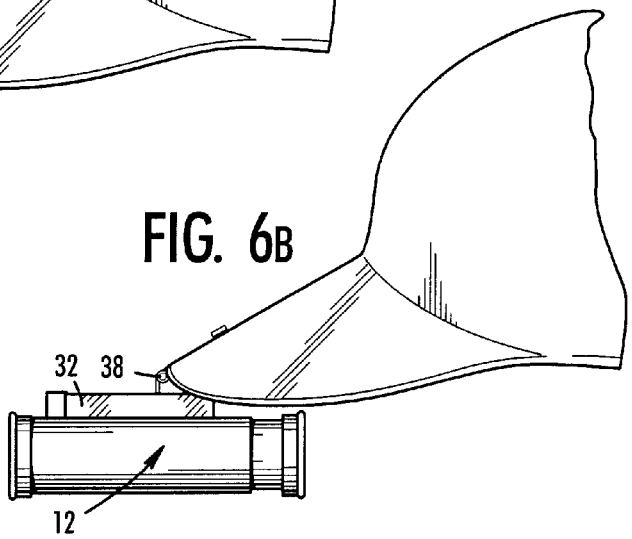
FIG. 6B is a side view the headgear with vertical and horizontal adjustments for the binoculars, according to a preferred embodiment of the present invention.
Figure 7A:
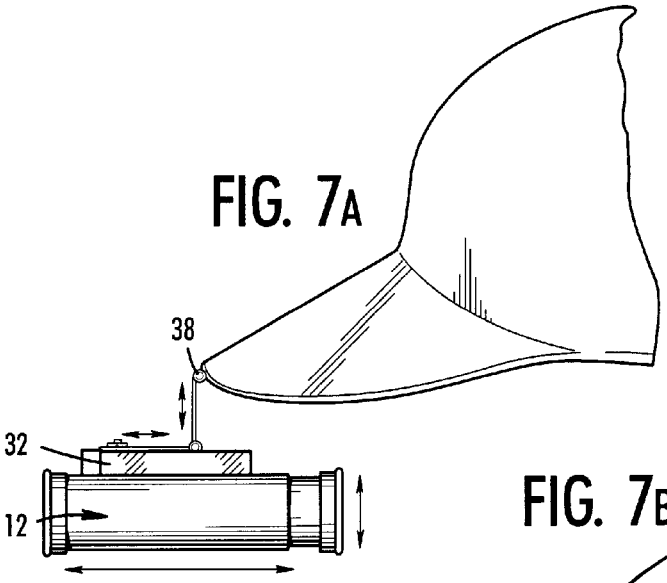
FIG. 7A is a side view the headgear with vertical and horizontal adjustments for the binoculars, according to a preferred embodiment of the present invention.
Figure 7B:
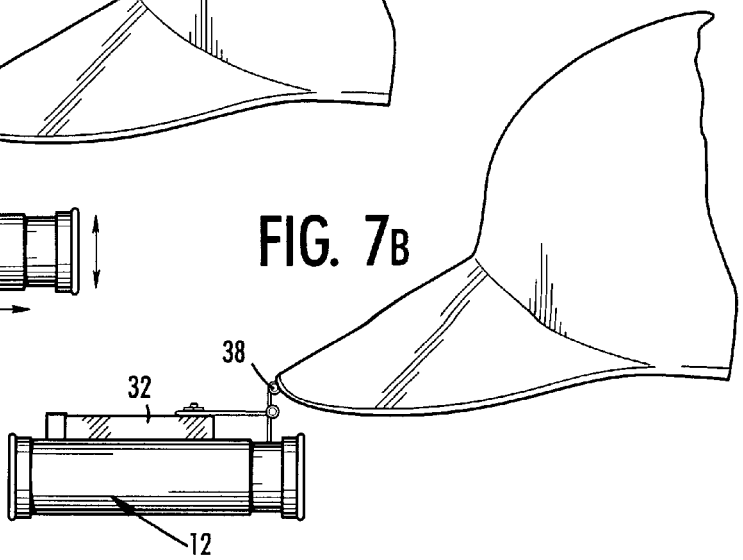
FIG. 7B is a side view the headgear with vertical and horizontal adjustments for the binoculars, according to a preferred embodiment of the present invention.

Binoculars 12 are attached to the brim 20 of headgear 10 such that binoculars 12 may be positioned below brim 20 while in use or above brim 20 while not in use using a hinge 38 as illustrated in FIG. 2. Hinge 38 has a L-shaped bracket 36 attached to the binocular bridge 32 and a flat plate member 40 attached to brim 20. Plate member 40 is preferably rectangular, but may be any shape that provides sufficient support for binoculars 12. Plate member 40 is preferably attached using screws 42, but rivots, adhesive, or any other fastener may be used. Both bracket 36 and plate 40 may be adjustable as seen in FIGS. 6A–6B and 7A–7B. Bracket 36 is shaped such that binoculars 12 are aligned with the user's eyes in the lowered position. Bracket 36 is of suitable width and thickness to support binoculars 12. Bracket 36 is preferably attached to binoculars 12 using rivots 44, but may be attached using screws, adhesive or any fastener. Instead of using screws or rivots to secure the bracket 36 and plate 40, they may be adjustable as seen in FIGS. 6A–6B and 7A–7B. An alternative embodiment, illustrated in FIGS. 6A–6B, plate 40 slidably engages brim 20 so that it is horizontally adjustable. Bracket 36 is slidably engaged with bridge 32 of binoculars 12 for vertical adjustment. Another alternative embodiment is illustrated by FIGS. 7A–7B such that both horizontal and vertical adjustment are provided. Plate 40 slidably engages bridge 32 of binoculars 12 for horizontal adjustment. Bracket 36 provides vertical adjustment by slidably engaging plate 40.

Headset 14 is attached to the crown 22 of headgear 10 with earphones 54 positioned to correspond with the user's ears. Headset 14 preferably contains a radio (not shown) in electrical connection with earphones 54 so that the user may receive broadcasts and listen using the earphones 54; however, headset 14 may contain a cassette-tape deck, compact disk player, two-way radio or any other electronic equipment that transmits sounds. In order to further assist in receiving transmissions, antenna 56 may be mounted on earphones 54 in electrical connection with radio (not shown). Antenna 56 may be attached to either earphone 54, and is preferably cylindrical in shape with a length and diameter suitable for receiving radio signals. Headset 14 preferably has two earphones 54 positioned for each ear, but may contain merely one earphone 54 for one of the user's ears.

Earphones 54 are attached to headgear 10 by locking stop 52 into slot 50 located preferably on each side of the crown 22 positioned above the user's ears. Stop 52 is cylindrical in shape with a flange on the end that engages slot 50. Slot 50 is a depression that contains a ridge which engages the flange on stop 52 to secure stop 52 to slot 50. Each earphone 54 may be independently rotated about stop 52 so that the earphones 54 may be placed away while not in use as seen in FIG. 2. Earphones 54 may be adjusted by moving stop 52 within slot 50. Depending upon the angle at which slot 50 is placed on headgear 10, moving stop 52 with respect to slot 50 may provide both horizontal and vertical adjustment.

Fan 16 is mounted on top of crown 22 in order to cool the user. Headgear 10 has aperture 64 on top of crown 22 positioned such that fan blades 62 blow directly down on user's head. Fan 16 is preferably of the type that is driven using batteries so that an electrical outlet is not needed. Fan 16 is mounted to headgear 10 preferably using adhesive, but may be attached using screws, rivots or any other suitable fastening means. Fan 16 contains preferably a switch 60 in electrical connection with fan motor (not shown) that may adjust blade 62 speed so that fan 16 may blow at different speeds.

Receiver 70 is mounted on crown 22 to receive special frequency broadcasts that are transmitted at certain sporting events. For example, at some automobile races, the conversations of the pit crew are broadcast at known frequencies. On the face of receiver, at least one button is attached for tuning. Preferably, receiver has a button to tune a higher frequency 72 and a button for tune in a lower frequency 74. In the preferred embodiment, receiver 70 can receive transmissions in the frequency range of pit crew transmissions.

It will be apparent to those skilled in the art that many changes and substitutions can be made to the preferred embodiment herein described without departing from the spirit and scope of the present invention.

What is claimed is:

1. A device for watching a sporting event, said device comprising:

a headgear having crown and a brim, said crown having an aperture therethrough;

a fan, carried by said headgear so that said fan covers said aperture in said crown, said fan blowing into said aperture of said crown; and binoculars rotatably attached to said brim so that said binoculars may be rotated between a position below said brim and a position above said brim.

2. The device as recited in claim 1, said device further comprising a headset carried by said headgear, said headset having an electronic communications device and earphones in electrical connection with said electronic communications device, said earphones attached to said crown of said headgear.

3. The device as recited in claim 2, wherein said electronic communications device is selected from the group consisting of a radio capable of tuning frequencies, a cassette-tape deck, a compact disk player, and a two-way radio.

4. The device as recited in claim 3, wherein said earphones are rotatably attached to said crown said headgear.

5. The device as recited in claim 3, wherein said fan is an adjustable speed fan.

6. The device as recited in claim 2, wherein said earphones are rotatably attached to said crown of said headgear.

7. The device as recited in claim 6, wherein said can is an adjustable speed fan.

8. The device as recited in claim 1, wherein said fan is an adjustable speed fan.

9. A device for watching a sporting event, said device comprising:

a headgear having crown and a brim, said crown having an aperture therethrough;

a fan, carried by said headgear so that said fan covers said aperture in said crown, said fan blowing into said aperture of said crown; and binoculars rotatably attached to said brim so that said binoculars may be rotated between a position below said brim and a position above said brim; and a headset carried by said headgear, said headset having an electronic communications device and earphones in electrical connection with said electronic communications device, said earphones attached to said crown of said headgear.

10. The device as recited in claim 9, wherein said electronic communications device is selected from the group consisting of a radio capable of tuning frequencies, a cassette-tape deck, a compact disk player, and a two-way radio.

11. The device as recited in claim 10, wherein said earphones are rotatably attached to said crown of said headgear.

12. The device as recited in claim 9, wherein said earphones are rotatably attached to said crown of said headgear.

13. The device as recited in claim 12, wherein said electronic communications device can receive frequencies in the range of pit crew transmissions.

14. The device as recited in claim 12, wherein said binoculars are attached to said brim uising a bracket so that said binoculars can be vertically adjusted.

15. The device as recited in claim 9, wherein said earphones are rotatably attached to said crown of said headgear so that said earphones can be independently rotated.

16. The device as recited in claim 9, wherein said fan is an adjustable speed fan.

17. The device as recited in claim 9, wherein said electronic communications device can receive frequencies in the range of pit crew transmissions.

18. The device as recited in claim 9, wherein said binoculars are attached to said brim using a bracket so that said binoculars can be vertically adjusted.

19. The device as recited in claim 9, wherein said binoculars are attached to said brim using a bracket so that said binoculars can be horizontally adjusted.

20. The device as recited in claim 9, wherein said headgear is made from hard plastic.

* * * * *